US009346286B1

(12) United States Patent
Wu

(10) Patent No.: US 9,346,286 B1
(45) Date of Patent: May 24, 2016

(54) PRINTING-DRIVING CONTROL DEVICE AND METHOD FOR THERMAL TRANSFER OVERPRINTER

(71) Applicant: SHANGHAI DIKAI CODING INDUSTRY CO., LTD., Shanghai (CN)

(72) Inventor: Qiuliang Wu, Shanghai (CN)

(73) Assignee: Shanghai Dikai Coding Industry Co., Ltd., Shanghai (CN)

( * ) Notice: Subject to any disclaimer, the term of this patent is extended or adjusted under 35 U.S.C. 154(b) by 0 days.

(21) Appl. No.: 14/795,916

(22) Filed: Jul. 10, 2015

(30) Foreign Application Priority Data

Jan. 20, 2015 (CN) ..... 2015 1 0027339

(51) Int. Cl.
*B41J 2/17* (2006.01)
*B41J 2/325* (2006.01)

(52) U.S. Cl.
CPC ..... *B41J 2/325* (2013.01)

(58) Field of Classification Search
CPC ..... B41J 29/393; B41J 29/28; B41J 29/02; B41J 11/42; B41J 2/04505
USPC ..... 347/37
See application file for complete search history.

(56) References Cited

U.S. PATENT DOCUMENTS 8,777,374 B2 * 7/2014 Naruse ..... B41J 2/2103 347/37
8,876,253 B2 * 11/2014 Iesaki ..... B41J 25/001 347/37
8,944,563 B2 * 2/2015 Takayanagi ..... B41J 25/001 347/37

* cited by examiner

*Primary Examiner* — Lamson Nguyen
(74) *Attorney, Agent, or Firm* — Alan D. Kamrath; Kamrath IP Lawfirm, P.A.

(57) ABSTRACT

A printing-driving control device and a method for a thermal transfer overprinter includes pre-drive shaft is connected to two bearings through their inner bores and is fixed to pre-drive support base. Pre-drive support base is connected to pre-drive carriage through pre-drive support shaft. Print spindle is fixed to spindle mounting block and is also connected to pre-drive carriage and print-head assembly through inner bores. Print pressure strut is installed through one inner bore of pre-drive carriage. Pre-drive fixing block is fixed to pre-drive carriage. As pre-drive support base moves to the right along arc on support plate, it rotates anticlockwise around pre-drive support shaft due to resistance of arc. Thus, print-head assembly stretches out and print-head moves down to print. After printing, print-head moves up to its home position. The invention has a simpler and smaller mechanical construction which is more energy-efficient, cost-effective, convenient and practical. The invention is particularly suitable for the thermal transfer overprinter in flexible package coding, and can be applied to all occasions.

7 Claims, 8 Drawing Sheets

PRINTING-DRIVING CONTROL DEVICE AND METHOD FOR THERMAL TRANSFER OVERPRINTER

BACKGROUND OF THE INVENTION

The present invention relates to a thermal transfer overprinter, especially to its printing-driving control device and method applied in flexible packaging.

The working process for existing thermal transfer overprinters is as follows: when coder gets a printing signal, the cylinder or the electromagnet drives the print-head down, giving contact force between ribbon and packing film. Meanwhile, control system controls print-head to heat and to print ribbon's ink layer onto the film. After printing, control system controls air cylinder to deflate or electromagnet to cut off power so that print-head goes back (at this point, print-head is away from the film so that the ribbon could be wound up and the film could move for a small distance preparing for next print.

At the present, the driving principle for the print-head's going down and up is achieved by means of pneumatic control or electromagnet control. The pneumatic control needs more spare parts so it's more costly and complicated in installation. Besides, the lack of air source in many application fields can also affects its functioning. Although electromagnet control does not need air source, we need high power electromagnet to provide enough stress for driving print-head. So the size of electromagnet is big and the mechanical construction of electromagnet control system is relatively complex and has higher requirements and cost for machine design and installation.

Therefore, technicians in this field are making great efforts to develop a set of new and modified printing-driving control device for thermal transfer overprinter.

BRIEF SUMMARY OF THE INVENTION

The invention intends to provide a set of printing-driving control device for a thermal transfer overprinter. It solved the problem that the current thermal transfer overprinter needs pneumatic elements or electromagnetic mechanical structure for print-head driving, which is complicated and costly.

The technical solution of the invention is as follows:

The printing-driving control device includes Motor, Basic Plate, Driving Wheel, T-belt, Driven Shaft, Driven Wheel, Print Spindle and Print-head Assembly. The control device features as it also includes Pre-Drive Shaft, Bearings, Pre-Drive Carriage, Pre-Drive Support Base, Spindle Mounting Block, Support Plate, Springs, Pre-Drive Support Shaft, Track Base, Track, Reset Spring, Fixing Block, Driving Block, Print Pressure Strut, and Pre-Drive Fixing Block.

Bearings described above include First Bearing and Second Bearing. Pre-Drive Shaft is connected between First Bearing and Second Bearing and is fixed to Pre-Drive Support Base. Pre-Drive Support Base is connected to Pre-Drive Carriage through Pre-Drive Support Shaft and can rotate around Pre-Drive Support Shaft on the surface of Pre-Drive Carriage.

Print Spindle described above is fixed to Spindle Mounting Block and is also connected to Pre-Drive Carriage and Print-head Assembly through inner bores. Print Pressure Strut is installed through one inner bore of Pre-Drive Carriage. Buffer Spring is installed between Print Pressure Strut and Pre-Drive Fixing Block. Pre-Drive Fixing Block is fixed to Pre-Drive Carriage so that Print Pressure Strut could move flexibly in the inner bore of Pre-Drive Carriage.

Spindle Mounting Block described above is installed on Track Base, and Track Base on Track, Track on Basic Plate. Fixing Block and Driving Block are both installed on Spindle Mounting Block. Driving Block is used to fix T-belt so that Motor's power can be transmitted to Spindle Mounting Block through T-belt, and then this power makes Pre-Drive Carriage and Print-head Assembly accomplish synchronous motion along Track.

Pre-Drive Carriage is elastically connected with Spindle Mounting Block by Reset Spring.

Printing Shaft is installed on the end of Print-head Assembly. Springs include First Spring and Second Spring. Pre-Drive Carriage is elastically connected with Print-head Assembly by First Spring and Second Spring, so that Print Pressure Strut is in contact with Printing Shaft to accomplish power transmission.

Basic Plate is installed with First Sensor and Second Sensor to detect Print-head Assembly.

Print-head Assembly does reciprocating motion between First Sensor and Second Sensor in a work period and achieves signal perception by Magnetic Sheet on Peel Roller Assy installed on Spindle Mounting Block.

Basic Plate is installed with First Ribbon Roller and Second Ribbon Roller for Ribbon winding.

The printing-driving control device and method: As Pre-Drive Support Base moves to the right along the arc on Support Plate, it rotates anticlockwise around Pre-Drive Support Shaft due to the resistance of the arc. Thus Print-head Assembly stretches out and when it moves to the top of Support Rubber the print-head moves down to print.

As First Bearing and Second Bearing move to the right of Support Rubber, Magnetic Sheet on Peel Roller Assy detects signal from Second Sensor, and then control system stops Motor immediately. At this moment, First Bearing and Second Bearing are to the right edge of Support Rubber, and due to the pulling force of Reset Spring and counterforce of Rubber Mat, First Bearing and Second Bearing roll to the right, driving Pre-Drive Support Base to rotate to the other end of Pre-Drive Carriage, and at the meantime, the height difference of Pre-Drive Support Base leads to the raise of Print-head Assembly.

Print-head Assembly goes back to home position and keeps distance with Rubber Mat, so that in a printing period, print head goes down to print and then goes back to home position after printing, so as not to affect the moving of Printing Film in below.

When applying the printing-driving control system provided by the invention, we only need simple mechanical structure to achieve same function, thus it's convenient and practical and can greatly reduce cost, simplify structure, save energy and will not be influenced by the lack of air source; meanwhile, the new structure in the invention makes the coding machine very compact and can be applied to all occasions, largely extending application field.

The printing-driving control system in the invention adopts the combination of bearing and rod, and achieves the up and down movement of print-head by height difference of Support Plate and Support Rubber caused by the motion of bearings along the track on Support Plate. The working process is driven by the motor, including print-head's going down, printing, and going back to home position after one printing motion. The whole process does not need any pneumatic element or high-cost and energy-intense electromagnet, but take the advantage of flexibility and delicacy of rolling bearings and related mechanical structure to achieve the down-up movements of print-head which can only be accomplished by complicated structures. The printing process saves fabricating cost and energy since it is driven by the motor, the same with other integrated thermal transfer overprinter, from which we can see that the invention attains the application effect and technical breakthrough which other device is not able to reach.

The printing-driving control device and method for the thermal transfer overprinter in the invention can be directly applied to intelligent thermal transfer overprinter especially for flexible package. It accomplishes the print-head driving including down-up motions by pure mechanical structure which is simpler, more effective and energy-saving.

DESCRIPTION OF THE DRAWINGS

The illustrative embodiments may best be described by reference to the accompanying drawings where.

Figure 1:
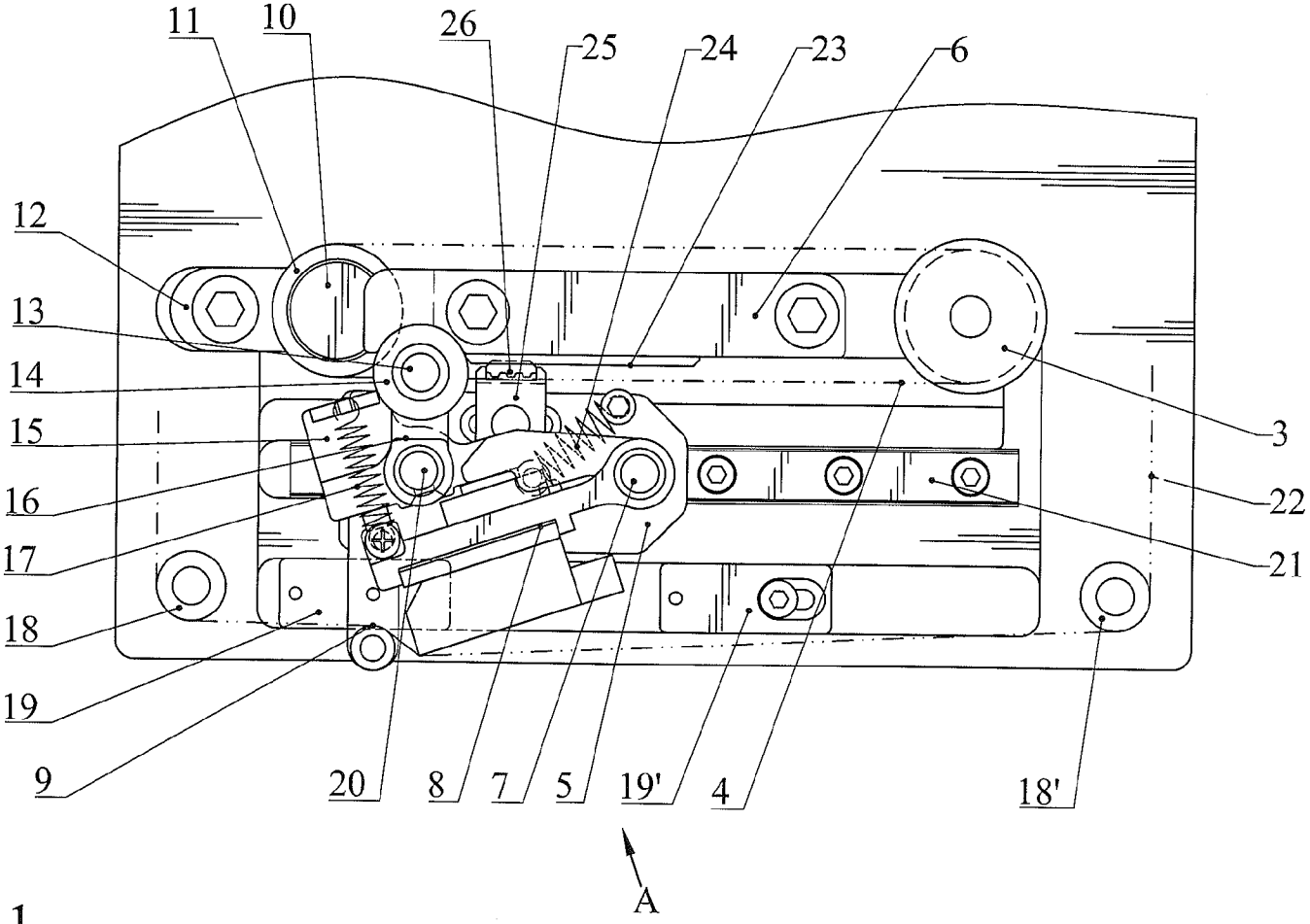
FIG. 1 is a top view for a printing-driving control device of a thermal transfer overprinter in this invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "bottom", "side", "end", "portion", "section", "spacing", "length", "depth", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

Following is the detailed demonstration by the combination of attached figures and application cases.

Figure 2:
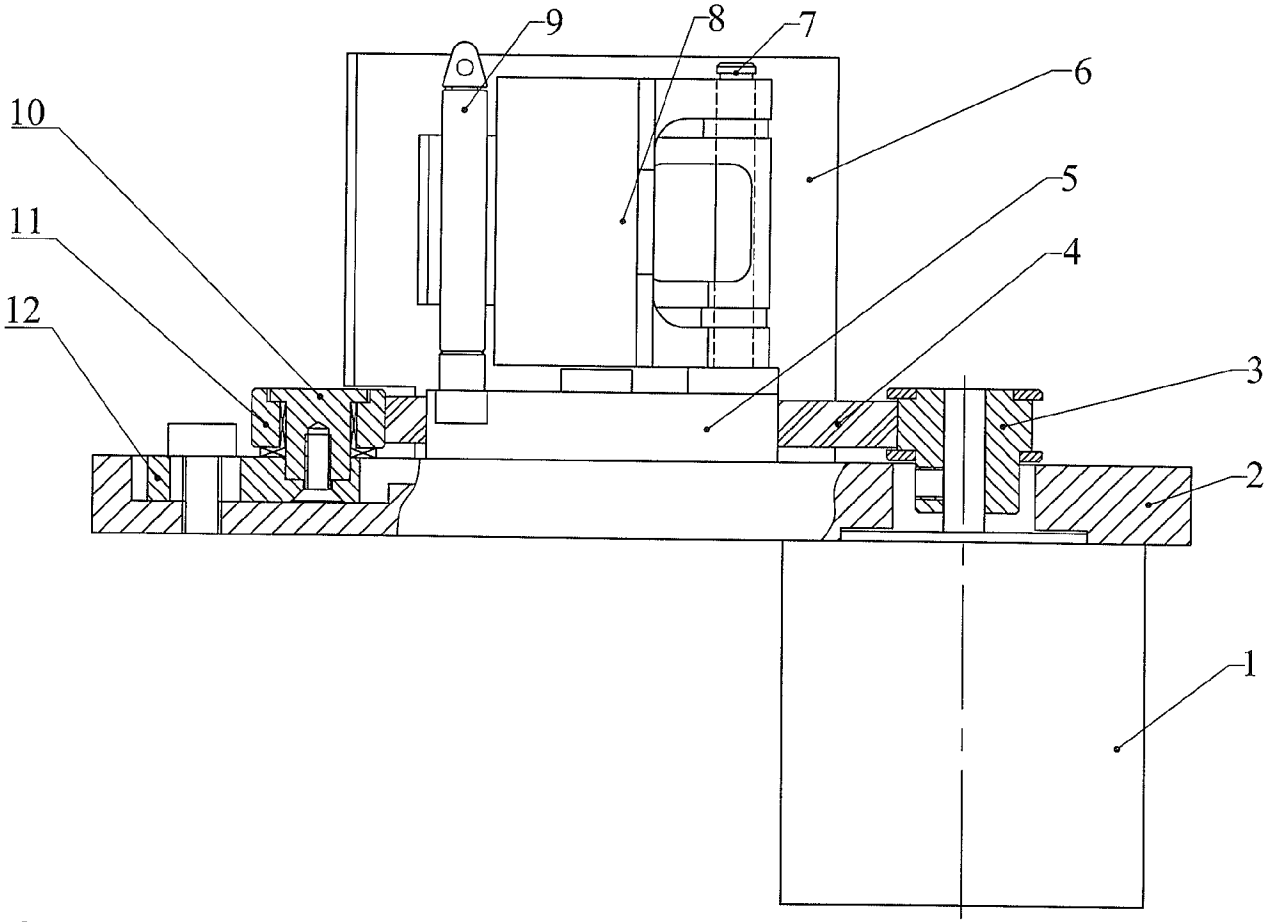
FIG. 2 is a front view for a part of the printing-driving control device in FIG. 1.
Figure 3:
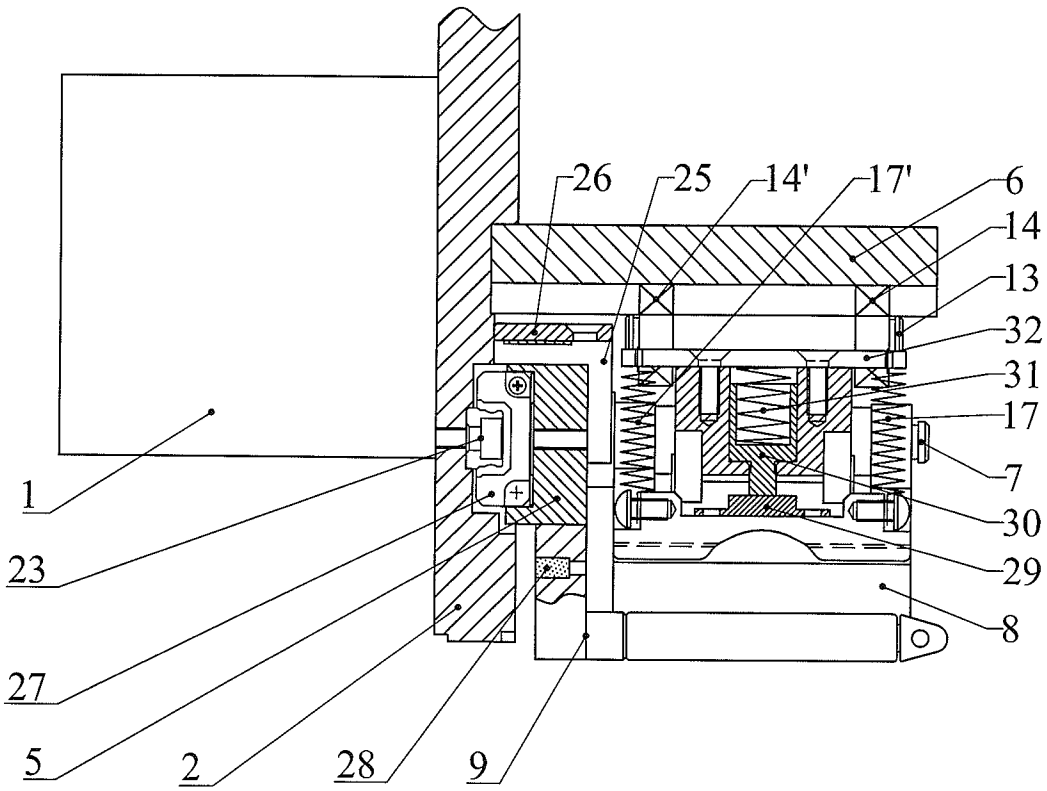
FIG. 3 is a right view of the printing-driving control device.

Please refer to FIGS. 1 to 3, a printing-driving control device for a invented thermal transfer overprinter includes Motor 1, Basic Plate 2, Driving Wheel 3, T-Belt 4, Driven Shaft 10, Driven Wheel 11, Print Spindle 7, Print-head Assembly 8, Pre-Drive Shaft installed on Basic Plate 2, Bearings, Pre-Drive Carriage 15, Pre-Drive Support Base 16, Spindle Mounting Block 5, Support Plate 6, Springs, Pre-Drive Support Shaft 20, Track Base 27, Track 21, Reset Spring 24, Fixing Block 25, Driving Block 26, Print Pressure Strut 30, and Pre-Drive Fixing Block 32.

Motor 1 is installed on Basic Plate 2. Driving Wheel 3 is fixed to the output shaft of Motor 1. Driven Shaft 10 punctures into inner bore of Driven Wheel 11 and is fixed to Tension Adjust Block 12, enabling Driven Wheel 11 to rotate around Driven Shaft 10 but limiting Driven Wheel 11's axial moving. Tension Adjust Block 12 is fixed to Basic Plate 2, making T-Belt 4 maintains proper tension. Driving Wheel 3 is connected with Driven Wheel 11 through T-Belt 4.

Bearings include First Bearing 14 and Second Bearing 14'. Pre-Drive Shaft 13 is connected between First Bearing 14 and Second Bearing 14' and is fixed to Pre-Drive Support Base 16. Pre-Drive Support Base 16 is connected to Pre-Drive Carriage 15 through Pre-Drive Support Shaft 20, and can rotate a given angel around Pre-Drive Support Shaft 20 on the surface of Pre-Drive Carriage 15.

Print Spindle 7 is fixed to Spindle Mounting Block 5 and is also connected to Pre-Drive Carriage 15 and Print-head Assembly 8 through inner bores; Print Pressure Strut 30 is installed through one inner bore of Pre-Drive Carriage 15. Buffer Spring 31 is installed between Print Pressure Strut 30 and Pre-Drive Fixing Block 32. Pre-Drive Fixing Block 32 is fixed to Pre-Drive Carriage 15 referring to FIG. 3 so that Print Pressure Strut 30 could move flexibly in the inner bore of Pre-Drive Carriage 15. This can guarantee that when the distance between Print-head Assembly 8 and Rubber Mat 34 is fairly short, the stress between them could be adjusted to a proper range by the elastic deformation of Buffer Spring 31, avoiding the damage of Print-head Assembly 8 and any work error due to over stress. Printing Shaft 29 is installed on the end of Print-head Assembly 8. Springs include First Spring 17 and Second Spring 17'. Pre-Drive Carriage 15 is elastically connected with Print-head Assembly 8 by First Spring 17 and Second Spring 17', so that Print Pressure Strut 30 is in contact with Printing Shaft 29 to accomplish power transmission.

Spindle Mounting Block 5 is installed on Track Base 27, and Track Base 27 on Track 21, Track 21 on Basic Plate 2. Fixing Block 25 and Driving Block 26 are both installed on Spindle Mounting Block 5. Driving Block 26 is used to fix T-belt 4 so that Motor 1's power can be transmitted to Spindle Mounting Block 5 through T-belt 4, and then this power makes Pre-Drive Carriage 15 and Print-head Assembly 8 accomplish synchronous motion along Track 21.

Support Plate 6 is installed on Basic Plate 2. Support Gasket 23 is fixed to Support Plate 6. Pre-Drive Carriage 15 is elastically connected with Spindle Mounting Block 5 by Reset Spring 24. In the pull of Reset Spring 24, Pre-Drive Support Base 16 flexibly installed on Pre-Drive Carriage 15 as well as First Bearing 14 and Second Bearing 14' installed on Pre-Drive Support Base 16 clings to the surface of Support Plate 6 or Support Gasket 23, and the motion of Pre-Drive Support Base 16 is directed by the height change of Support Plate 6 and Support Gasket 23.

Referring to FIG. 1, Basic Plate 2 is installed with First Sensor 19 and Second Sensor 19' to detect Print-head Assembly 8. Print-head Assembly 8 does reciprocating motion between First Sensor 19 and Second Sensor 19' in a work period and achieves signal perception by Magnetic Sheet 28 on Peel Roller Assy 9 installed on Spindle Mounting Block 5. As showed in FIG. 1, Basic Plate 2 is installed with First Ribbon Roller 18 and Second Ribbon Roller 18' for Ribbon 22 winding.

Figure 4:
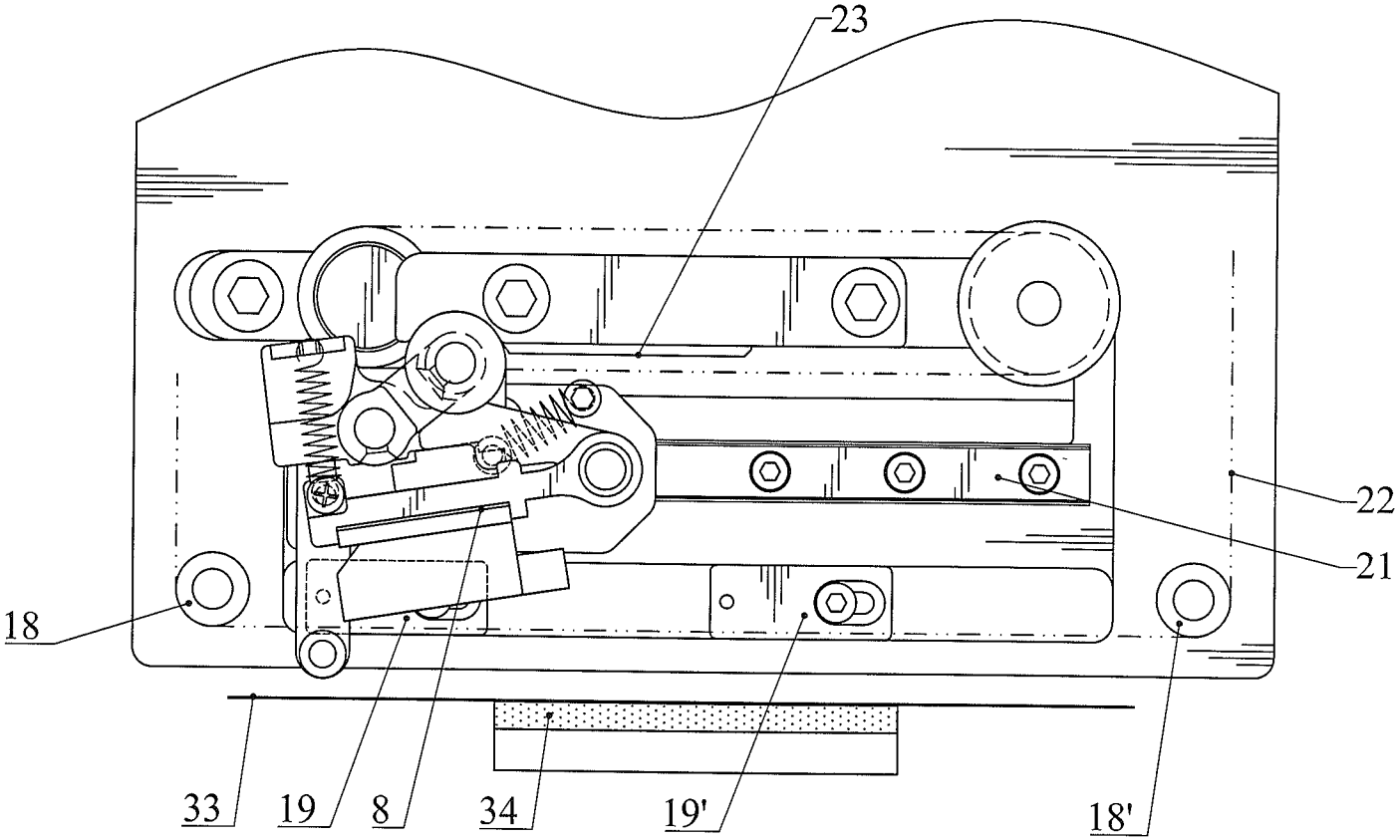
FIGS. 4 to 6 are the schematic diagrams for one working cycle of the thermal transfer overprinter in an intermittent mode.
Figure 5:
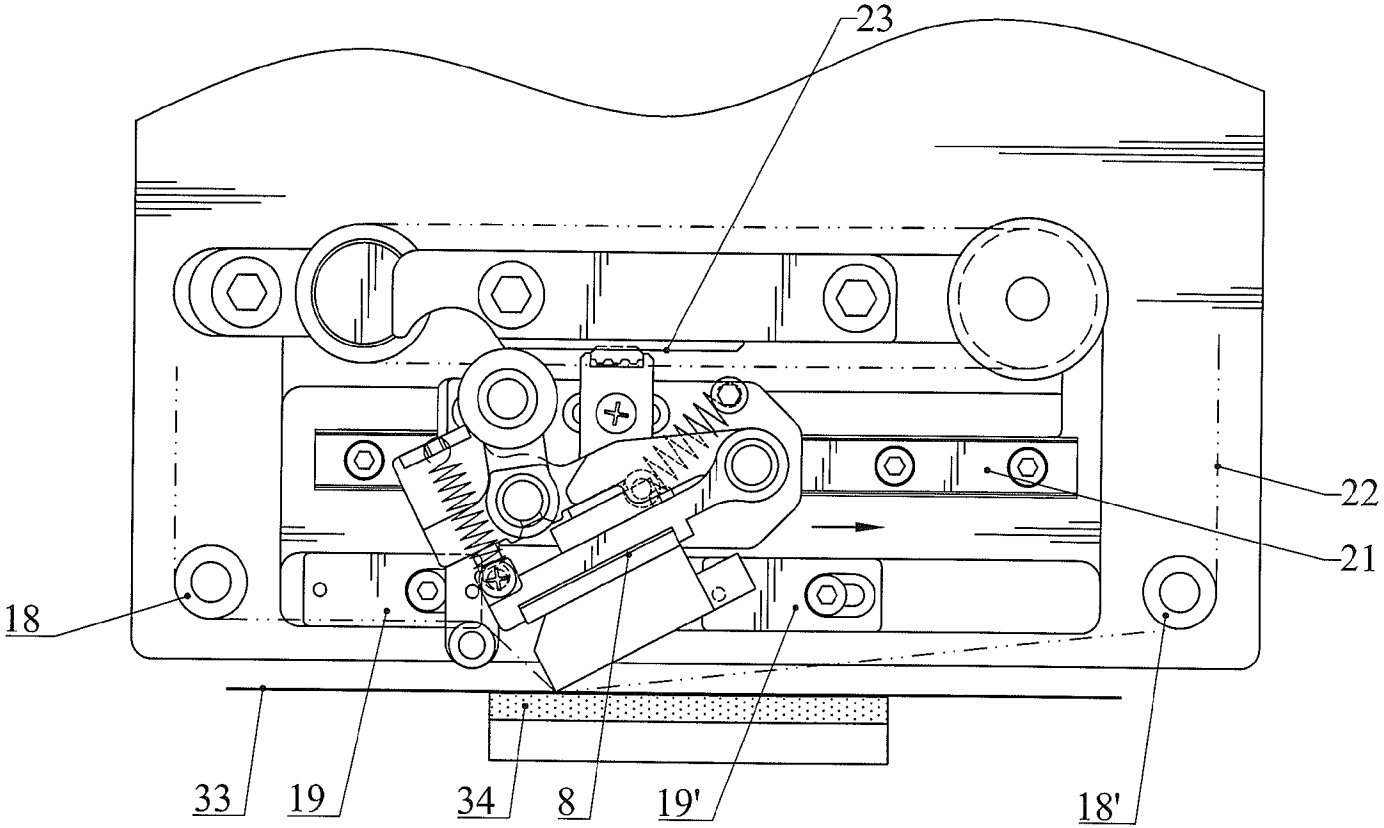
Figure 6:
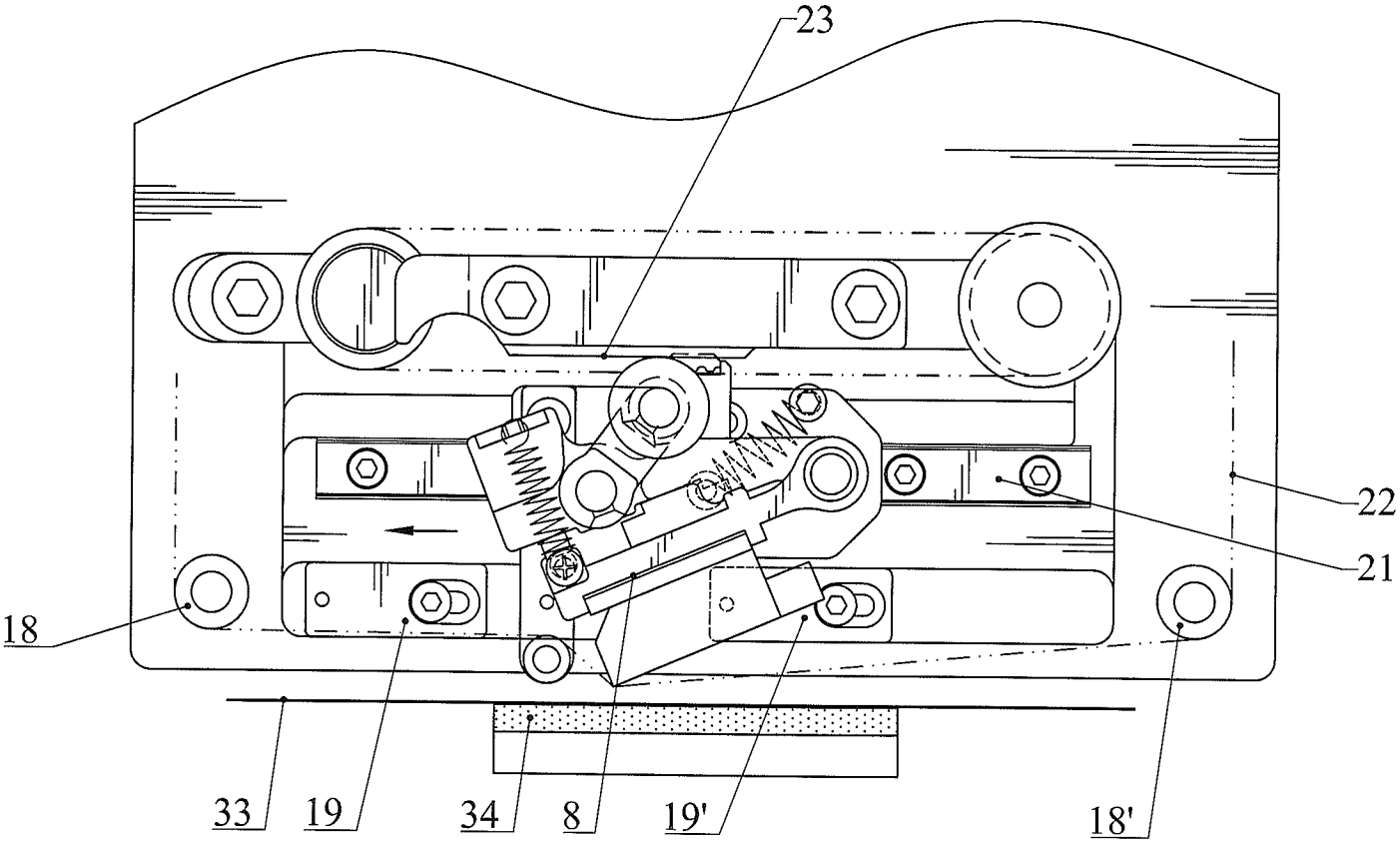

Please refer to FIGS. 4 to 8. This invention provides a printing-driving control system for the thermal transfer overprinter. FIG. 4 is an initial state, which is convenient for ribbon winding; FIGS. 5 and 6 are the driving control scheme for the invention in an intermittent mode.

Once coder receives printing signal, control system starts Motor 1, and then the power of Motor 1 is transmitted to T-belt 4 through Driving Wheel 3, which is fixed to the output shaft of Motor 1. Fixing Block 25 and Driving Block 26 are both installed on Spindle Mounting Block 5. Driving Block 26 is used to fix T-belt 4 so that Motor 1's power can be transmitted to Spindle Mounting Block 5 through T-belt 4, and then this power makes Pre-Drive Carriage 15 and Print-head Assembly 8 accomplish synchronous motion along Track 21. As Pre-Drive Support Base 16 moves to the right along an arc on Support Plate 6, it rotates anticlockwise around Pre-Drive Support Shaft 20 due to the resistance of the arc. Thus, Print-head Assembly 8 stretches out. FIG. 5 shows the working state when Print-head Assembly 8 moves to the top of Support Gasket 23, which is the printing position (print-head goes down). As First Bearing 14 and Second Bearing 14' move to the right of Support Gasket 23, Magnetic Sheet 28 on Peel Roller Assy 9 detects signal from Second Sensor 19', and then control system stops Motor 1 immediately. At this moment, First Bearing 14 and Second Bearing 14' are to the right edge of Support Gasket 23, and due to the pulling force of Reset Spring 24 and counterforce of Rubber Mat 34, First Bearing 14 and Second Bearing 14' roll to the right, driving Pre-Drive Support Base 16 to rotate to the other end of Pre-Drive Carriage 15, and at the meantime, a height difference of Pre-Drive Support Base 16 leads to the raise of Print-head Assembly 8. FIG. 6 shows that after printing, Print-head Assembly 8 goes back to home position driven by Motor 1 and keeps distance with Rubber Mat 34, so that in a printing period, print head goes down to print and then goes back to home position (Referring to FIG. 4) after printing, so as not to affect the moving of Printing Film 33 in below. As Print-head Assembly 8 moves above First Sensor 19, Magnetic Sheet 28 on Peel Roller Assy 9 detects First Sensor 19 and stops Motor 1, preparing for next printing period.

Figure 7:
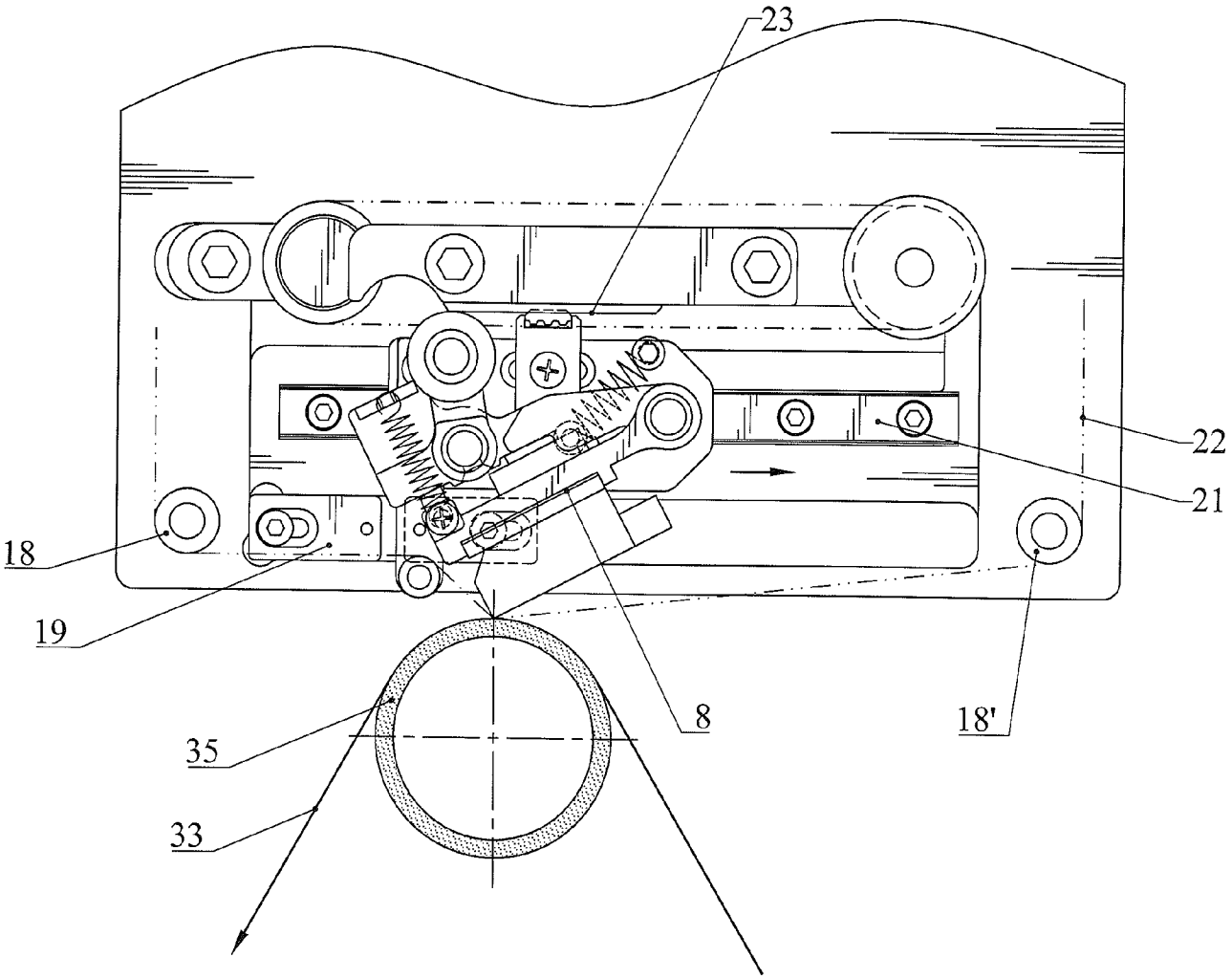
FIGS. 7 and 8 are the schematic diagrams for one working cycle of the thermal transfer overprinter in a continuous mode.
Figure 8:
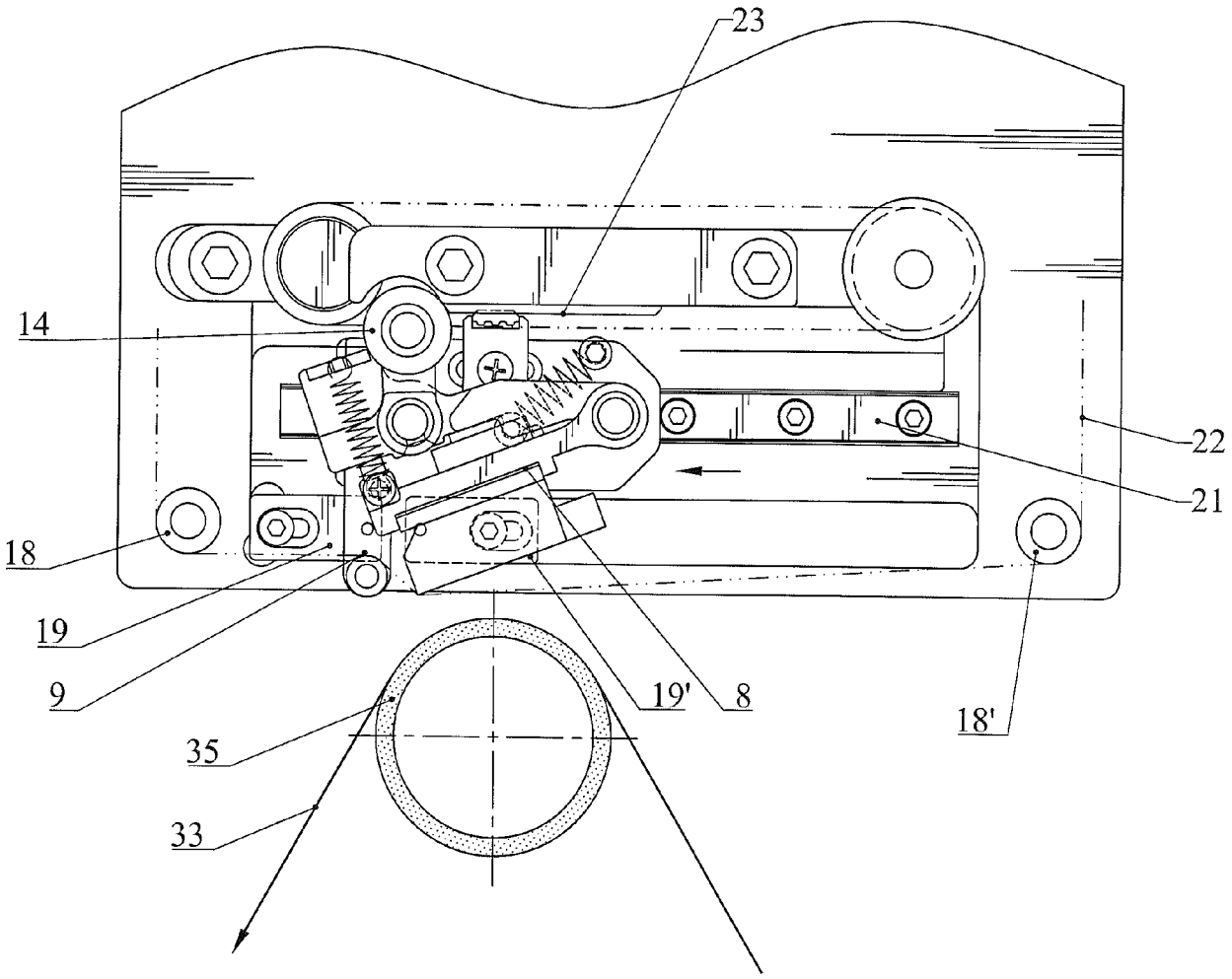

FIGS. 4, 7 and 8 show the driving control method for the thermal transfer overprinter in the invention in a continuous mode. FIG. 4 is the initial state. FIG. 8 shows the up position of Print-head Assembly 8.

When the coder enters the state of operating preparation after seft-exam, control system starts Motor 1, driving Print-head Assembly 8 moves to the position showed in FIG. 8 along Track 21. Magnetic Sheet 28 on Peel Roller Assy 9 detects First Sensor 19 and stops Motor 1. At this moment, Print-head Assembly 8 stretches out and is in the up position showed in FIG. 8 (not touching Printing Film 33). As the coder receives printing signal, control system starts Motor 1, driving Print-head Assembly 8 to the position of Second Sensor 19'. Magnetic Sheet 28 on Peel Roller Assy 9 detects Second Sensor 19' and stops Motor 1. FIG. 7 shows the down position of Print-head Assembly 8, which is the position in printing. At this moment, First Bearing 14 and Second Bearing 14' are at the top of Support Gasket 23. There exists contact pressure between Print-head Assembly 8, Printing Film 33 and Rubber Roller 35 for achieving printing motion. After one printing period, control system makes Motor 1 rotate in reverse, driving Print-head Assembly 8 goes back to First Sensor 19, which is the up motion of Print-head Assembly 8 preparing for next printing period. During one period of printing, Print-head Assembly 8 moves to and fro as shown in FIGS. 7 and 8, achieving one printing.

To conclude, this invention with the printing-driving control device of the thermal transfer overprinter could achieve same function in simplified mechanical structure, which is cost-saving, energy-efficient and practical, not restricted to whether there is air source in application field; meanwhile, the new structure in this invention make the device more compact and smaller, and can be applied to almost all occasions, greatly increasing the application scope. The printing-driving control device and method for the thermal transfer overprinter in the invention can be directly applied to intelligent thermal transfer overprinter especially for flexible package. It accomplishes the print-head driving including down-up motions by pure mechanical structure which is simpler, more effective and energy-saving.

Of course, normal technicians in this field should recognize that the above implementation is only used to demonstrate this invention, but not the limit to this invention. Any change or transform in the spirit of this invention about above implementation falls into the legal protection scope of this invention as said in the claims.

The invention claimed is:

1. A printing-driving control device for a thermal transfer overprinter compressing: a motor, a basic plate, a driving wheel, a T-belt, a driven shaft, a driven wheel, a print spindle and a print-head assembly;

wherein the control device further includes a pre-drive shaft, a plurality of bearings, a pre-drive carriage, a pre-drive support base, a spindle mounting block, a support plate, a plurality of springs, a pre-drive support shaft, a track base, a track, a reset spring, a fixing block, a driving block, a print pressure strut, and a pre-drive fixing block;

wherein the plurality of bearings include a first bearing and a second bearing, wherein the pre-drive shaft is connected between the first bearing and the second bearing and is fixed to the pre-drive support base, wherein the pre-drive support base is connected to the pre-drive carriage through the pre-drive support shaft and can rotate a given angel around the pre-drive support shaft on a surface of the pre-drive carriage;

wherein the print spindle is fixed to the spindle mounting block and is connected to the pre-drive carriage and the print-head assembly through inner bores, wherein the print pressure strut is installed through one inner bore of the pre-drive carriage, wherein a buffer spring is installed between the print pressure strut and the pre-drive fixing block, wherein the pre-drive fixing block is fixed to the pre-drive carriage so that the print pressure strut could move flexibly in the inner bore of pre-drive carriage; and wherein the spindle mounting block is installed on the track base, and the track base on the track, with the track on the basic plate, wherein the fixing block and the driving block are both installed on the spindle mounting block, wherein the driving block is used to fix the T-belt so that the motor's power can be transmitted to the spindle mounting block through the T-belt, and then the motor's power makes the pre-drive carriage and the print-head assembly accomplish synchronous motion along the track.

2. The printing-driving control device for the thermal transfer overprinter as claimed in claim 1, wherein the pre-drive carriage is elastically connected with the spindle mounting block by the reset spring.

3. The printing-driving control device for the thermal transfer overprinter as claimed in claim 1, wherein a printing shaft is installed on an end of the print-head assembly, wherein the plurality of springs include a first spring and a second spring, wherein the pre-drive carriage is elastically connected with the print-head assembly by the first spring and the second spring, so that the print pressure strut is in contact with the printing shaft to accomplish power transmission.

4. The printing-driving control device for the thermal transfer overprinter as claimed in claim 1, wherein the basic plate is installed with a first sensor and a second sensor to detect the print-head assembly.

5. The printing-driving control device for the thermal transfer overprinter as claimed in claim 4, wherein the print-head assembly does reciprocating motion between the first sensor and the second sensor in a work period and achieves signal perception by a magnetic sheet on a peel roller assy installed on the spindle mounting block.

6. The printing-driving control device for the thermal transfer overprinter as claimed in claim 1, wherein the basic plate is installed with a first ribbon roller and a second ribbon roller for a ribbon winding.

7. A printing-driving control method for a thermal transfer overprinter using the printing-driving control device as claimed in claim 1, wherein as the pre-drive support base moves to the right along an arc on the support plate, the pre-drive support base rotates anticlockwise around the pre-drive support shaft due to a resistance of the arc, wherein the print-head assembly stretches out and when the print-head assembly moves to the top of a support gasket, and wherein a print-head moves down to print;

wherein as the first bearing and the second bearing move to the right of the support gasket, a magnetic sheet on a peel roller assy detects signal from a second sensor, and then the control device stops the motor immediately, wherein the first bearing and the second bearing are to the right edge of support gasket, and due to a pulling force of the reset spring and counterforce of a rubber mat, the first bearing and the second bearing roll to the right, the driving pre-drive support base to rotate to the other end of the pre-drive carriage, and at the meantime, the height difference of the pre-drive support base leads to the raise of the print-head assembly; and wherein the print-head assembly goes back to a home position and keeps distance with the rubber mat, so that in a printing period, the print-head goes down to print and then goes back to the home position after printing, so as not to affect the moving of a printing film in below.

* * * * *